United States Patent [19]

Matteucci

[11] 4,403,497

[45] Sep. 13, 1983

[54] BEAD BENDING TOOL

[76] Inventor: Felix V. Matteucci, 1422 S. 61st Ave., Cicero, Ill. 60650

[21] Appl. No.: 262,757

[22] Filed: May 11, 1981

[51] Int. Cl.[3] ..... B21D 9/08

[52] U.S. Cl. ..... 72/409; 72/416

[58] Field of Search ..... 72/409, 410, 412, 415, 72/416; 81/418, 420, 421, 422, 423, 424, 425 R, 425 A

[56] References Cited

U.S. PATENT DOCUMENTS

| | | | |
|---|---|---|---|
| 74,601 | 2/1868 | Rothschild | 72/409 |
| 2,082,653 | 6/1937 | Rawson | 72/415 |
| 2,253,906 | 8/1941 | Lehman | 72/416 |
| 2,477,689 | 8/1949 | Feinbloom | 72/409 |
| 2,477,727 | 8/1949 | Engberg | 81/423 |
| 2,679,775 | 6/1954 | Fleming | 81/420 |
| 3,461,713 | 8/1969 | Donath | 72/409 |

FOREIGN PATENT DOCUMENTS

| | | | |
|---|---|---|---|
| 669598 | 11/1929 | France | 72/409 |
| 507980 | 1/1956 | Italy | 72/409 |
| 88618 | 7/1958 | Netherlands | 72/415 |

*Primary Examiner*—Gene Crosby

*Attorney, Agent, or Firm*—Dressler, Goldsmith, Shore, Sutker & Milnamow, Ltd.

[57] ABSTRACT

A tool for bending articles having a bead or rolled edge is provided with levers defining handles and arms. Removably mounted on the arms are a male jaw member and a female jaw member having substantially complementary arcuate workfaces and grooves to receive the bead. The workface of the female jaw member preferably has a radius of curvature that gradually increases along the width of the female jaw member. Each jaw member is provided with a ledge which engages with an outobard surface of a slot in each arm to add rigidity to the jaw member to prevent warpage during use.

17 Claims, 5 Drawing Figures

BEAD BENDING TOOL

TECHNICAL FIELD

This invention relates to tools for curving or bending articles having a rolled edge or bead and more particularly perforated or grilled angie shapes having a central bead as used for reinforcing wall corners on which plastering is applied.

BACKGROUND OF THE INVENTION

In preparing wall corner reinforcing articles for plastering archways over doors or windows it is sometimes necessary to establish a uniform curvature along the bead of the article. Cuts are made through the perforated or grilled side and article is bent to the desired curve. In the past this has usually been accomplished by hand resulting in an imperfect curve.

A tool having curved jaws in a plier-like arrangement would facilitate bending. One such tool is disclosed in U.S. Pat. No. 2,253,906 to Lehman. However, that tool is difficult to use, and does not provide interchangeable jaws with sufficient rigidity to avoid bending or warping during use. That tool also has jaws of uniform curvature which do not progressively bend the article into an uniform curved shape. The present invention obviates the shortcomings of that tool and provides a bending tool with interchangeable jaws having different curved workfaces that allow the tool to be used effectively in many different applications.

SUMMARY OF THE INVENTION

The tool contemplated by the present invention has the general characteristics and form of a pair of pliers or tongs consisting of two levers which move or pivot in a pivot plane about a pivot axis such as a pin. The longer portion of the levers to one side of the pivot pin constitute handles and the shorter portion of the levers on the other side of the pivot pin constitute arms adapted to carry jaw members. Preferably the forward ends of the arms are each provided with a slot which has inboard and outboard surfaces located with respect to one another so that the outboard surfaces of each slot are substantially parallel when the tool is closed.

Each jaw member has a workface and a ledge. The jaw members are removably mounted on the arms with the ledges received in the slots and abutting the outboard surfaces of the arms. This allows the entire height of the jaw member to reinforce the workface and thus to prevent warping and deflection during use. The two jaw members, a male jaw member of predetermined width and a wider female jaw member, both have curved workfaces which coact with one another. The curved workface of the male jaw member is substantially complementary to adjacent portion of the workface of the female jaw member.

Preferably, the male jaw member has a male workface with a substantially uniform radius of curvature along its width. The female jaw member preferably has a female workface with a varying radius of curvature along its width. Preferably, an initial portion of the female workface at one end has a radius of curvature substantially that of the radius of curvature of the male workface. The radius of curvature of the female workface then increases gradually, but not necessarily uniformly, across the female workface to the other end of the workface where the radius of curvature is larger and may become infinite, that is the female workface becomes straight. This gradually increasing radius of curvature across the female workface permits a beaded article to be gradually and accurately bent to a desired curvature as the tool is moved along the article bead, repeatedly crimping sections of the article. This change in radius of curvature can be characterized as a monotonically increasing radius of curvature.

Previous devices having a uniform radius across their workfaces generally produce unevenly curved finished articles because of the repeated crimpings and movement of a tool needed to curve a large article in a work environment. The present invention progressively curves the article as it is repeatedly crimped as opposed to previous devices which attempt to curve a section of an article in one crimp.

Each jaw member workface is provided with a groove adapted to receive the bead of the article to be curved or bent. In use, the bead of a beaded article is received between the two jaw members and in juxtaposition with respect to the grooves. Pressure is then applied to the handles to bring the two jaw members into contact, while the jaw workfaces act on the article to curve the bead of the article as desired. The tool may then be moved along the bead a distance equal to about one half the width of the male jaw member and the article is crimped again. Repeating this process produces the uniform curve desired.

The design of the arms and slots together with the jaw members permits the use of replaceable jaw members that have sufficient bulk, i.e. height and thickness, to avoid deflection and warping during use, especially during vigorous use on relatively stiff articles. The bulk also helps to prevent warpage or other damage to the jaw members when the tool may be dropped on the floor. The outboard surfaces and arms also help to prevent warpage of the jaw members by engaging with the ledges on the jaw members.

The jaw members are removable and can be replaced with another set having a different curvature on the workface or a different groove. Thus the tool is easily adapted to accommodate differing beads or differing requirements for the curve of the finished product.

Numerous other advantages and features of the present invention will become readily apparent from the following detailed description of the invention, the accompanying examples, and the appended claims.

DESCRIPTION OF THE PREFERRED EMBODIMENTS

Figure 1:
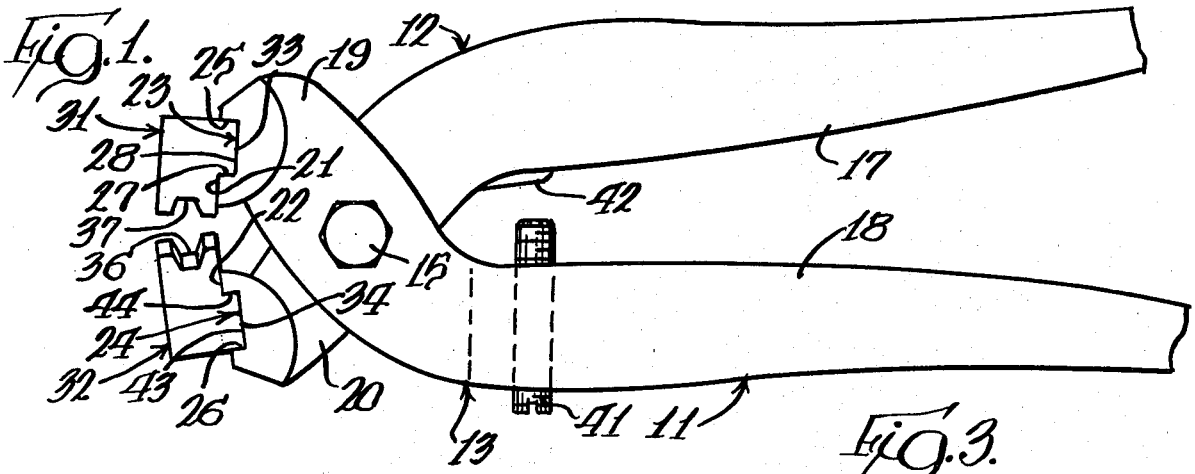
FIG. 1 shows a side elevation of a tool embodying the present invention and including handles, arms which move in a pivot plane and which have removably mounted jaw members.

While this invention is susceptible of embodiment in many different forms, there are shown in the drawings and will be described in detail, preferred embodiments of the invention. It should be understood, however, that the present disclosure is to be considered as an exemplification of the principles of the invention and is not intended to limit the invention to the embodiments illustrated. The precise shapes and sizes of the components described are not essential to the invention unless otherwise indicated. For ease of description, the tool of this invention will be described in an upright operating position and such terms as top, bottom, front, etc., are used in reference to this position. It will be understood, however, that the tool of this invention may be used in an orientation other than the position described.

Referring to FIGS. 1–4, the tool 11 comprises a pair of levers 12 and 13 which are joined together by a pivot pin 15 and move or pivot in a pivot plane perpendicular to the longitudinal axis of the pivot pin. The levers include handles, i.e., top handle 17 and bottom handle 18, on one side of the pivot pin, and arms, i.e., top arm 19 and bottom arm 20, on the other side. The handles preferably are at least about five times in length as the arms, and more preferably about ten times longer. The forward ends of the arms 19 and 20 most distant from the pivot pin 15 comprise jaw member receiving surfaces 21 and 22 each having a slot such as slots 23 and 24. Each slot comprises an outboard surface, an inboard surface and a bottom. Slot 23 is defined by outboard surface 25, inboard surface 27 and bottom 28. Likewise, slot 24 is defined by outboard surface 26, inboard surface 44 and bottom 43. When the tool 11 is in a closed position, the two outboard surfaces 25 and 26 of each slot 23 and 24 are substantially parallel. The advantage of this configuration is described below.

A female jaw member 31 having a ledge 33 is removably mounted on the top arm 19 with the ledge received into the slot 23 and abutting the outboard surface 25. Similarly, a male jaw member 32 also having a ledge 34 is removably mounted on the bottom arm 20 with the ledge received into the slot 24 and engaging the other outboard surface 26. It is also possible that the male jaw member 32 can be mounted on the top arm 19 with the female jaw member 31 being mounted on the bottom arm 20. The jaw members may be retained on the arms by any suitable mounting means such as screws 35 set perpendicular to the slots and extending generally in the direction of the handles.

Figure 2:
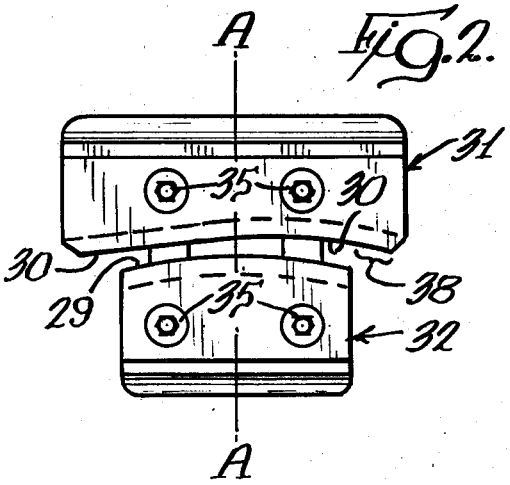
FIG. 2 shows an enlarged front elevational view of the tool shown in FIG. 1 and in particular the jaw members on the front portion of the arms.

FIG. 2 illustrates a preferred embodiment of this invention. The male jaw member is provided with curved or arcuate male workface 29, and the female jaw member is provided with a curved or arcuate female workface 30. Juxtaposed portions of the workfaces substantially complement each other and the trailing portion 38 of the female workface 30 preferably has the same radius of curvature as the male workface. The trailing portion 38 is the last part of the female workface 30 to contact the article to be bent as the tool is moved along the article repeatedly crimping it. The curvature of the workfaces is chosen to be similar to the desired curvature of the finished article. Since the jaw members are removably mounted, they can be removed and replaced with a different pair of jaw members having a different desired curvature or the relative positions of the jaw members of a given set can be reversed if desired. The width of the male jaw member is less than the width of the coacting, substantially complementary female jaw member. Preferably the female jaw member is about 30% or even 50% greater in width than the male jaw member. The differences in width allow the article to be progressively bent to produce a more uniform curve in the finished article.

Preferably, the male workface 29 has a substantially uniform radius of curvature whose center of curvature coincides with the center line A—A of the male jaw member shown in FIG. 2. The radius of curvature of the female workface 30 preferably increases across the width of the female jaw member. This change or increase in radius of curvature need not be uniform, nor need it be continuous, rather the radius of curvature need only be defined as a monotonically increasing function. By "monotonically increasing" it is meant that the radius of curvature may be constant for part of the width or may increase along the width from one end to the other end of the female jaw member or both of the foregoing can be present. The radius of curvature may approach infinity, that is the female workface may become straight at one end of the female jaw member.

Preferably, the radius of curvature of the female workface 30 along the trailing portion 38 is approximately equal to the radius of the male workface 29, and increases toward infinity, i.e., becomes a straight workface extending tangentially from the curved section. This curved section preferably has its center of curvature offset from the center line A—A of the male jaw member.

Alternatively, the curvature of the female workface 30 may have a radius in a central region about A—A substantially equal to the radius of the male workface 29 and have greater and lesser radiuses on either side of the central region. Another alternative is to have the radius of curvature of the female workface 30 be constant and approximately equal to the radius of the male workface 29 over a majority of the width of the female jaw member 31.

As shown in FIG. 2, the female workface 30 has its smallest radius of curvature along the trailing portion 38 on the right side of FIG. 2 with the largest radius on the left side of FIG. 2. This corresponds to having the smallest radius at the bottom of FIG. 4 and the greatest radius at the top of FIG. 4. In use with this configuration, the tool is moved in FIG. 4 from the bottom of the figure to the top of the figure as article 40 is repeatedly crimped. Interchanging the jaw members or using a different set allows the direction of movement to be reversed. The article 40 is crimped in one location and the tool is moved over a distance of about one-half the width of the male jaw member and the article is crimped again. This process continues until the desired curve is given to the article.

The varying curvature of the female workface 30 has the effect of progressively curving the article 40 as it is repeatedly crimped by the tool. Unlike previous tools with uniformly curved workfaces, a varying workface introduces a bending movement to curve the article along the region of contact with the workface. Because one end is of greater radius or straight, the force needed to crimp the article is reduced. Each crimp adds curve to the article until the desired curve is attained. This results in a uniform curvature in the finished article. Prior art devices having a uniform curvature in their female jaw members have difficulty in producing a uniform curvature in the finished article. Repeated crimping using a uniformly curved workface does not progressively curve the article, but attempts to achieve the desired curve in one crimp. Such devices also require greater force to operate. Unfortunately this may unnecessarily deform or distort the bead and result in a non-uniform curve where adjacent crimps overlapped.

Figure 3:
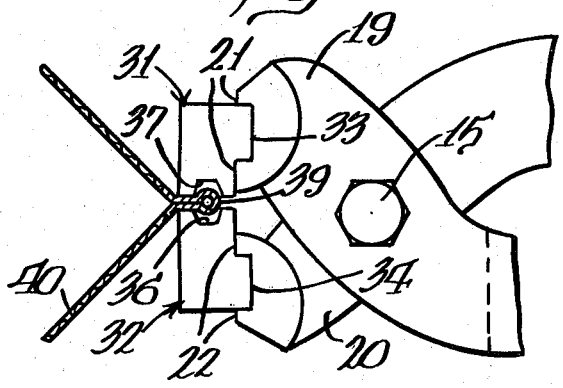
FIG. 3 is a fragmentary view, partly in section, of the tool of the present invention showing the jaw members engaged with an article having a bead.
Figure 4:
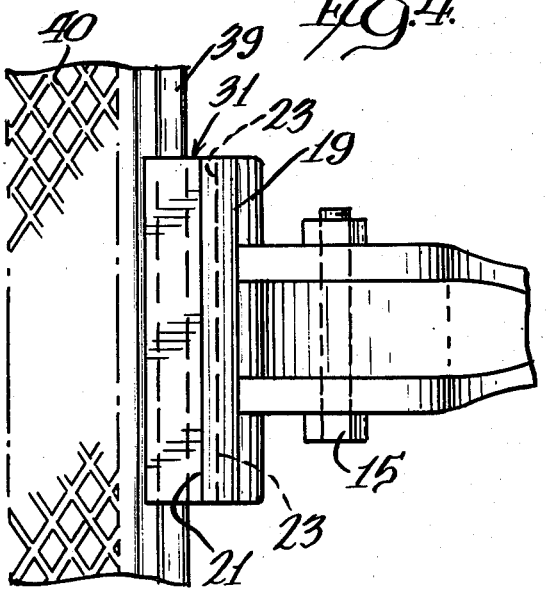
FIG. 4 is a fragmentary top view of the tool of the present invention.

Each jaw member is provided with grooves 36 and 37 which are adapted to receive a bead 39 such as the central bead on article 40 used for reinforcing wall corners over which plastering is to be applied (FIG. 3). The grooves may be trapezoidal in shape. As with the curvature of the workface, different shapes of grooves can be made available to meet specific job requirements. It is preferred that the grooves be of a size relative to the bead 39 so that a minimum amount of deformation is caused to the bead as the article 40 is curved. The integrity of the bead 39 needs to be maintained to provide a proper corner or edge for a plastered surface. Several pairs or sets of these removably mounted jaws may be provided with each set having different grooves or workfaces curved on different radii to suit the desired curvatures of the arched stairways, windows, passageways, or the like.

One of the handles, the bottom handle 18 in the illustrated embodiment, may be provided with an adjustable stop screw 41 which in conjunction with an abutment surface 42 on the top handle 17 may be set to limit the opening between the jaw members when the tool is in the closed position. This helps to avoid distorting the article beyond what is needed to bend it to the proper curvature.

In operation, the beaded article 40 is placed between the jaw members with the bead 39 located substantially aligned with the grooves. Pressure is then placed on the handles and the groove closes about the bead without crushing it as the article is bent to the desired curve. The tool is then moved along the bead and the article is crimped again. This process is continued until the article is bent to the desired curve. If a different curve is desired, the jaw members can be removed and replaced with another set having a different curve configuration. Similarly a different set can be used to meet different groove requirements.

Figure 5:
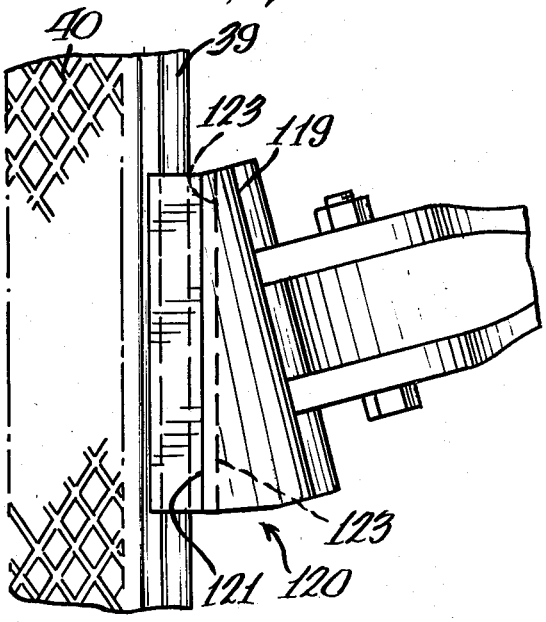
FIG. 5 shows an alternative embodiment of the present invention similar to that shown in FIG. 4 but with the arms modified so that the jaw members are mounted at an angle with respect to the pivot plane.

Alternatively, as shown in FIG. 5, the arms 119 and 120 may be provided with jaw member receiving surfaces 121 which together with the slots 123 are at an acute angle with respect to the pivot plane. This angle can be from about 80 degrees to about 45 degrees, with an angle of about 75 degrees being preferred. This allows an operator to comfortably hold and use the tool to one side of his body and still maintain the proper alignment with the bead on the article. The slots on both arms are of substantially the same configuration, thus the jaw positions are readily reversible, providing a right-handed or left-handed tool as desired.

Referring to FIG. 2, another advantage of this tool is the height of the jaw members which can be attained with the present mounting structure. Also possible is a thicker jaw member i.e. of greater thickness from the front toward the handles (FIG. 3). This thickness and height provide bulk and rigidity which helps prevent deflection and warping as the tool is used. The ledges 32 and 34 on the back of the jaw members act like a cantilevered section to further provide rigidity for the jaw members.

The ledges are in abutment with the outboard surfaces 25 and 26 of the arms 19 and 20. Because the outboard surfaces are substantially parallel when the tool is closed, the force generated during bending of an article is transferred to these surfaces such that they reinforce the jaw members and hold them in place. Thus, the design of the present invention, unlike previous bead bending tools, has jaw members removably mounted on arms utilizing a structure that reinforces the workfaces to prevent warpage or deflection of the workfaces as the tool is used in bending objects that require considerable force.

Another advantage of the present invention is that there are no movable parts mounted on the arms forward of the pivot pin 15. This allows the maximum amount of leverage to be obtained when pressing on the handles to bend a bead between the jaw members. The placement of a stop screw forward of the pivot pin would reduce the leverage of the tool and thus impede its operation by requiring more force to be exerted on the handles. Accordingly, in the present invention, the adjustable stop screw 41 is mounted on one side of the handles, instead of one of the arms.

The foregoing specification is to be intended as illustrative and is not to be taken as limiting. Still other variations within the spirit and scope of this invention are possible and will readily present themselves to those skilled in the art.

I claim:

1. A tool for bending articles having a rolled edge or bead comprising:

(a) a pair of levers joined by a pivot pin, the levers being adapted for movement in a pivot plane and defining handles on one side of the pivot pin and arms having forward ends on the other side of the pivot pin, the forward end of each arm defining a slot having a bottom, an inboard surface and an outboard surface such that when the tool is placed in a closed position the two outboard surfaces are substantially parallel;

(b) a male jaw member removably mounted on the forward end of one of the arms and having an arcuate male workface provided with a groove adapted to receive the bead or rolled edge of the article, the male jaw member also being provided with a ledge to be received in the slot and adapted to engage the outboard surface of the slot of the arm the male jaw member is removably mounted on; and (c) a female jaw member removably mounted on the forward end of the other arm and having an arcuate female workface substantially complementary to the male workface and provided with the groove adapted to receive the bead of the article, the female jaw member being of greater width than the male jaw member, the female jaw member also being provided with a ledge to be received in the slot and to engage the outboard surface of the slot of the arm the female jaw member is removably mounted on;

said jaw members being retained on their respective arms by screws set substantially perpendicular to the slots and extending generally in the direction of the handles.

2. The tool of claim 1 wherein the length of the handles is at least ten times the length of the arms.

3. The tool of claim 1 wherein the width of the female jaw member is about 50% greater than the male jaw member.

4. The tool of claim 1 wherein one handle is provided with an abutment shoulder and the other handle is provided with an adjustable stop screw which engages with the abutment shoulder to set the minimum distance between the jaw members when the tool is fully engaged with a bead.

5. The tool of claim 1 wherein the slots in the arms are of substantially the same configuration and the ledges on the jaw members have substantially the same configuration permitting the interchanging of the jaws from one arm to the other.

6. The tool of claim 1 wherein the female workface has a radius of curvature that increases monotonically along the width of female jaw member.

7. The tool of claim 1 wherein the male workface has a substantially constant radius of curvature.

8. The tool in accordance with claim 7 wherein the female workface has a radius of curvature that increases monotonically along the width of female jaw member, and at a portion of the width the radius of curvature is approximately equal to the radius of curvature of the male workface.

9. A tool for bending articles having a rolled edge or bead comprising:

(a) a pair of levers joined by a pivot pin, the levers being adapted for movement in a pivot plane and defining handles on one side of the pivot pin and arms having forward ends on other side of the pivot pin, the forward end of each arm defining a jaw member receiving surface having a slot substantially parallel to the jaw member receiving surface, each slot having a bottom, inboard surface and an outboard surface such that when the tool is placed in a closed position the two outboard surfaces are substantially parallel;

(b) a male jaw member removably mounted on the forward end of one of the arms and having an arcuate male workface provided with a groove adapted to receive the bead or rolled edge of the article, the male jaw member also having a ledge to be received in the slot and engage the outboard surface of the slot of the arm the male jaw member is removably mounted on; and (c) a female jaw member removably mounted on the forward end of the other arm and having an arcuate female workface with a radius of curvature that increases monotonically along the width of the female jaw member and at least a portion thereof being substantially complementary to the male workface, the female jaw member being of greater width than the male jaw member, the female jaw member also provided with a groove adapted to receive the bead of the article and a ledge to be received in the slot and engage the outboard surface of the slot of the arm the female jaw member is removably mounted on;

said jaw members being retained on their respective arms by screws set substantially perpendicular to the jaw member engagement surface and extending generally in the direction of the handles.

10. The tool of claim 9 wherein the jaw member receiving surfaces are substantially perpendicular to the pivot plane.

11. The tool of claim 9 wherein the jaw member receiving surfaces are set at an angle with respect to the pivot plane of about 80 degrees to about 45 degrees.

12. The tool of claim 11 wherein the angle is about 75 degrees.

13. The tool of claim 9 wherein the length of the handles is at least five times the length of the arms.

14. The tool of claim 9 wherein the slots are substantially identical and the ledges on the jaw members are substantially identical permitting interchanging of the jaws from one arm to the other.

15. The tool of claim 9 wherein the male workface has a substantially constant radius of curvature.

16. The tool in accordance with claim 15 wherein the female workface has a radius of curvature at one end approximately equal to the radius of curvature of the male workface and monotonically increasing in radius toward the other end.

17. The tool in accordance with claim 16 wherein the portion of the female workface adjacent the other end is substantially straight.

* * * * *